US009273380B2

(12) United States Patent
Shugart et al.

(10) Patent No.: US 9,273,380 B2
(45) Date of Patent: Mar. 1, 2016

(54) ALUMINUM-CARBON COMPOSITIONS

(75) Inventors: Jason V. Shugart, Waverly, OH (US); Roger C. Scherer, Portsmouth, OH (US); Roger Lee Penn, Hedgesville, WV (US)

(73) Assignee: THIRD MILLENNIUM MATERIALS, LLC, Waverly, OH (US)

( * ) Notice: Subject to any disclaimer, the term of this patent is extended or adjusted under 35 U.S.C. 154(b) by 879 days.

(21) Appl. No.: 13/411,087

(22) Filed: Mar. 2, 2012

(65) Prior Publication Data

US 2012/0244033 A1 Sep. 27, 2012

Related U.S. Application Data

(60) Provisional application No. 61/449,406, filed on Mar. 4, 2011.

(51) Int. Cl.

| | |
|---|---|
| ***C22C 21/00*** | (2006.01) |
| ***C22C 32/00*** | (2006.01) |
| ***C22C 21/02*** | (2006.01) |
| ***C22C 21/08*** | (2006.01) |
| ***C22C 21/10*** | (2006.01) |

(52) U.S. Cl.

CPC ..... *C22C 21/02* (2013.01); *C22C 21/08* (2013.01); *C22C 21/10* (2013.01); *C22C 32/0052* (2013.01)

(58) Field of Classification Search

CPC ..... C22C 21/02; C22C 21/10; C22C 21/08; C22C 32/0052

USPC ..... 148/415–418, 437–440; 420/528–554

See application file for complete search history.

(56) References Cited

U.S. PATENT DOCUMENTS

| | | | |
|---|---|---|---|
| 1,204,927 | A | 11/1916 | Antisell |
| 1,775,159 | A | 9/1930 | Donaldson et al. |
| 2,060,133 | A | 11/1936 | Summey |
| 2,060,137 | A | 11/1936 | Bahney |
| 2,131,396 | A | 9/1938 | Zublin et al. |
| 2,177,070 | A | 10/1939 | Kikuchi |
| 2,670,284 | A | 2/1954 | Zvanut |
| 3,164,482 | A | 1/1965 | Renkey |
| 3,353,807 | A | 11/1967 | Sixel et al. |
| 3,385,494 | A | 5/1968 | Themelis et al. |
| 3,782,924 | A | 1/1974 | Van Houten |
| 3,891,426 | A | 6/1975 | Stawicky et al. |
| 3,896,257 | A | 7/1975 | Kinoshita |
| 3,908,072 | A | 9/1975 | Collin |
| 3,985,545 | A | 10/1976 | Kinoshita |
| 3,993,478 | A | 11/1976 | Hay et al. |
| 4,083,719 | A | 4/1978 | Arakawa et al. |
| 4,171,232 | A | 10/1979 | Finster et al. |
| 4,353,738 | A | 10/1982 | Persson |

(Continued)

OTHER PUBLICATIONS

International Search Report and Written Opinion, PCT/US2012/037543, Jun. 7, 2012.

(Continued)

*Primary Examiner* — Lois Zheng

(74) *Attorney, Agent, or Firm* — Thompson Hine LLP

(57) ABSTRACT

An aluminum-carbon composition including aluminum and carbon, wherein the aluminum and the carbon form a single phase material, characterized in that the carbon does not phase separate from the aluminum when the single phase material is heated to a melting temperature.

19 Claims, 4 Drawing Sheets
(4 of 4 Drawing Sheet(s) Filed in Color)

(56) References Cited

U.S. PATENT DOCUMENTS

| | | | |
|---|---|---|---|
| 4,385,930 | A | 5/1983 | Persson |
| 4,726,842 | A | 2/1988 | Reeve et al. |
| 4,767,451 | A | 8/1988 | Bergman et al. |
| 4,808,219 | A | 2/1989 | Metz |
| 4,865,806 | A | 9/1989 | Skibo et al. |
| 4,916,030 | A | 4/1990 | Christodoulou et al. |
| 4,946,647 | A | 8/1990 | Rohatgi et al. |
| 5,143,668 | A | 9/1992 | Hida |
| 5,200,003 | A | 4/1993 | Rohatgi |
| 5,219,819 | A | 6/1993 | Sharma et al. |
| 5,611,838 | A | 3/1997 | Fritz et al. |
| 5,632,827 | A | 5/1997 | Fujita et al. |
| 5,803,153 | A | 9/1998 | Rohatgi |
| 5,834,115 | A | 11/1998 | Weeks, Jr. et al. |
| 5,900,225 | A | 5/1999 | Mistry et al. |
| 6,036,889 | A | 3/2000 | Kydd |
| 6,063,506 | A | 5/2000 | Andricacos et al. |
| 6,110,817 | A | 8/2000 | Tsai et al. |
| 6,150,262 | A | 11/2000 | Go et al. |
| 6,228,904 | B1 | 5/2001 | Yadav et al. |
| 6,231,634 | B1 | 5/2001 | Shaw |
| 6,238,454 | B1 | 5/2001 | Polese et al. |
| 6,287,364 | B1 | 9/2001 | Mizuta et al. |
| 6,372,010 | B1 | 4/2002 | Shver et al. |
| 6,596,131 | B1 | 7/2003 | Scott et al. |
| 6,649,265 | B1 | 11/2003 | Kawamura et al. |
| 6,727,117 | B1 | 4/2004 | McCoy |
| 6,765,949 | B2 | 7/2004 | Chang |
| 6,799,089 | B2 | 9/2004 | Toulhoat |
| 6,984,888 | B2 | 1/2006 | Sung |
| 7,311,135 | B1 | 12/2007 | Suganuma et al. |
| 7,399,703 | B2 | 7/2008 | Kawakami |
| 7,468,088 | B1 | 12/2008 | Blankenhorn et al. |
| 7,767,113 | B2 | 8/2010 | Kobayashi |
| 8,541,335 | B2 | 9/2013 | Shugart et al. |
| 8,541,336 | B2 | 9/2013 | Shugart et al. |
| 2002/0019684 | A1 | 2/2002 | Toulhoat |
| 2002/0056915 | A1 | 5/2002 | Go |
| 2004/0265615 | A1 | 12/2004 | Kodas et al. |
| 2005/0061107 | A1 | 3/2005 | Hampden-Smith et al. |
| 2006/0194097 | A1 | 8/2006 | Kim et al. |
| 2007/0190348 | A1 | 8/2007 | Ichiki |
| 2008/0050589 | A1 | 2/2008 | Tsushima et al. |
| 2008/0093577 | A1 | 4/2008 | Khraishi et al. |
| 2009/0176090 | A1* | 7/2009 | So et al. ..... 428/367 |
| 2009/0180919 | A1 | 7/2009 | Blankenhorn et al. |
| 2010/0015032 | A1 | 1/2010 | Magario et al. |
| 2010/0035775 | A1 | 2/2010 | Viswanathan |
| 2010/0327233 | A1 | 12/2010 | Shugart et al. |
| 2013/0062572 | A2 | 3/2013 | Shugart et al. |
| 2013/0156633 | A1 | 6/2013 | Blankenhorn et al. |

OTHER PUBLICATIONS

Brown, Lloyd et al.; "Physical and Mechanical Characterization of a Nano Carbon Infused Aluminum-Matrix Composite"; Proceedings of the SAMPLE Fall Technical Conference; Ft. Worth, TX; pp. 1-16 (Oct. 17-Oct. 20, 2011).

WPH-M Powdered Activated Carbon; Calgon Carbon, Product Bulletin; p. 0411 (2011).

WPH-M Description found at http://www.wateronline.com/doc/wph-0001; Calgon Carbon (2011).

* cited by examiner

Electron Backscatter Diffraction

COLOR KEY

Color Coded Map Type: Inverse Pole Figure [001]

Aluminum

Boundaries: <none>

SEM Images of a fractured surface of AA6061-2.7% carbon composition

EDS Map of a Fractured Surface of AA6061-Carbon Composition Containing 2.7% Carbon Name:Date:10/6/2011 5:43:02 PMImage size:700 x 525Mag:8000xHV:5.0kV Filtered for carbon reflectance. Carbon appears red.

SEM Images of an as extruded surface of AA6061-2.7% carbon composition

ALUMINUM-CARBON COMPOSITIONS

RELATED PATENT APPLICATIONS

This application claims the benefit of U.S. Provisional Application No. 61/449,406, filed Mar. 4, 2011.

FIELD

The present application relates to compounds and/or compositions that include aluminum and carbon that are formed into a single phase material and, more particularly, to aluminum-carbon compositions wherein the carbon does not phase separate from the aluminum when the aluminum-carbon compositions are melted or re-melted.

BACKGROUND

Aluminum is a soft, durable, lightweight, ductile and malleable metal with appearance ranging from silvery to dull gray, depending on the surface roughness. Aluminium is non-magnetic and nonsparking Aluminum powder is highly explosive when introduced to water and is used as rocket fuel. It is also insoluble in alcohol, though it can be soluble in water in certain forms. Aluminium has about one-third the density and stiffness of steel. It is easily machined, cast, drawn and extruded. Corrosion resistance can be excellent due to a thin surface layer of aluminum oxide that forms when the metal is exposed to air, effectively preventing further oxidation. Aluminum-carbon composites are long known to suffer from corrosion due to galvanic reaction between the dissimilar materials.

SUMMARY

In one aspect, the disclosed metal-carbon composition may include aluminum and carbon, wherein the metal and the carbon form a single phase material and the carbon does not phase separate from the metal when the material is heated to a melting temperature, or sputtered by magnetron sputtering, or electron beam (e-beam) evaporation. In another aspect, the disclosed aluminum-carbon composition may consist essentially of the aluminum and the carbon.

Other aspects of the disclosed aluminum-carbon composition will become apparent from the following description and the appended claims.

BRIEF DESCRIPTION OF THE DRAWINGS

The patent or application file contains at least one photograph executed in color. Copies of this patent or patent application publication with color photograph(s) will be provided by the Office upon request and payment of the necessary fee.

DETAILED DESCRIPTION

Figure 1:
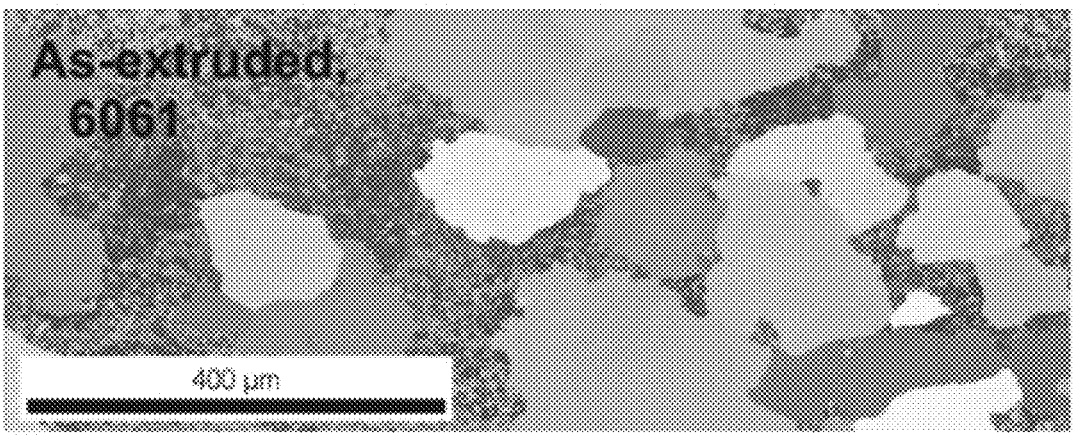
FIG. 1 is a comparison of the electron backscatter diffraction images of, as extruded, aluminum alloy 6061 and, as extruded, one embodiment of an aluminum-carbon composition, referred to as "covetic," containing aluminum alloy 6061 and 2.7 wt % carbon. The two images in FIG. 1 have different scales. The top image has a 400 μm scale and the bottom image has a 45 μm scale.
Figure 1:
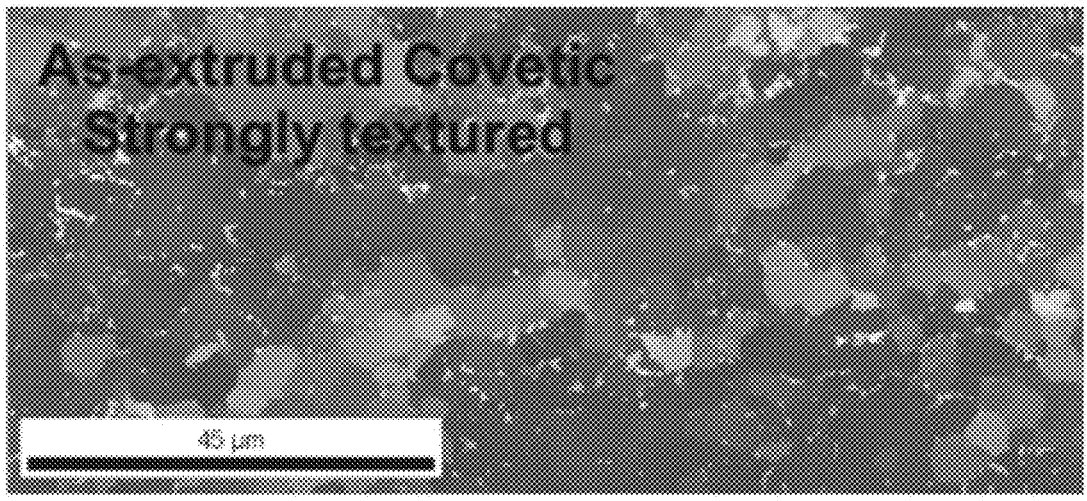
Figure 1:
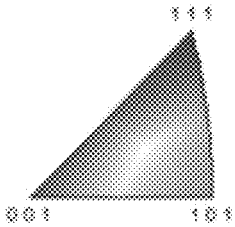

Aluminum-based compounds and/or compositions that have carbon incorporated therein are disclosed. The compounds or compositions are aluminum-carbon materials that form a single phase material, and in such a way that the carbon does not phase separate from the metal when the material is melted. The metal herein is aluminum. Carbon can be incorporated into the aluminum by melting the aluminum and maintaining the temperature during the procedure at a temperature above the melting point of the resulting aluminum-carbon material, mixing the carbon into the molten aluminum and, while mixing, applying a current of sufficient amperage to the molten mixture such that the carbon becomes incorporated into the aluminum, thereby forming a single phase metal-carbon material. The type of carbon for producing successful materials is discussed below.

It is important that the current is applied while mixing the carbon into the molten aluminum. The current is preferably DC current, but is not necessarily limited thereto. The current may be applied intermittently in periodic or non-periodic increments. For example, the current may optionally be applied as one pulse per second, one pulse per two seconds, one pulse per three seconds, one pulse per four seconds, one pulse per five seconds, one pulse per six seconds, one pulse per seven seconds, one pulse per eight seconds, one pulse per nine seconds, one pulse per ten seconds and combinations or varying sequences thereof. Intermittent application of the current may be advantageous to preserve the life of the equipment and it can save on energy consumption. Alternately, trials have been successful when the DC current was applied continuously for about 3 seconds to about several hours, with the only limitation being the load on the equipment. Of course, this range encompasses and therefore explicitly includes any combination of about 3 seconds to each number between several hours.

The current may be provided using an arc welder. The arc welder should include an electrode that will not melt in the metal, such as a carbon electrode. In carrying out the method, it may be appropriate to electrically couple the container housing the molten metal to ground before applying the current. Alternately, positive and negative electrodes can be placed generally within about 0.25 to 7 inches of one another. Placing the electrodes closer together increases the current density and as a result increases the bonding rate of the metal and carbon.

As used herein, the term "phase" means a distinct state of matter that is identical in chemical composition and physical state and is discernible by the naked eye or using basic microscopes (e.g., at most about 10,000 times magnification). Therefore, a material appearing as a single phase to the naked eye, but showing two distinct phases when viewed on the nano-scale should not be construed as having two phases.

As used herein, the phrase "single phase" means that the elements making up the material are bonded together such that the material is in one distinct phase.

While the exact chemical and/or molecular structure of the disclosed aluminum-carbon material is currently not known, without being limited to any particular theory, it is believed that the steps of mixing and applying electrical energy result in the formation of chemical bonds between the aluminum and carbon atoms, thereby rendering the disclosed metal-carbon compositions unique vis-à-vis known metal-carbon composites and solutions of metal and carbon, i.e., the new material is not a mere mixture. The aluminum-carbon material is not aluminum carbide. Aluminum carbide, $Al_4C_3$, decomposes in water with a byproduct of methane. The reaction proceeds at room temperature, and is rapidly accelerated by heating. Aluminum carbide also has a rhombohedral crystal structure. The aluminum-carbon materials disclosed herein, unlike aluminum powder and aluminum carbide, do not react with water. On the contrary, the aluminum-carbon materials made by the methods and with the materials disclosed herein are stable.

Currently existing Al—C metal matrix composites exhibit a galvanic reaction in the presence of water molecules (even moisture in the air). The aluminum-carbon materials disclosed herein do not exhibit a galvanic response and are stable even in high temperature, salt water corrosion testing. Moreover, the aluminum-carbon materials disclosed herein have been tested by advanced combustion techniques such as LECO combustion analyzers that operated in excess of 1500° C. and no carbon is detectable.

Without being bound by theory, it is believed that the carbon is covalently bonded to the aluminum in the aluminum-carbon materials disclosed herein. The bonds may be single, double, and triple covalent bonds or combinations thereof, but it is believed, again without being bound by theory, that the bonds are most likely previously undocumented bonds (i.e., a completely new bond type or arrangement of aluminum and carbon atoms not seen or found in any other material/compound). This belief is supported by tests where the bond survives magnetron sputtering, a 1500° C. oxygen plasma lance, and a DC Plasma Arc System that operates at temperatures in excess of 10,000° C. The aluminum-carbon material is melted during these processes and is re-deposited as a thin film of the same material. Accordingly, the bonds formed between the aluminum and the carbon are not broken, i.e., the carbon does not separate from the metal, merely by melting the resulting single phase metal-carbon material or "re-melting" as described above. Furthermore, without being limited to any particular theory, it is believed that the disclosed aluminum-carbon material is a nanocomposite material and, as evidenced by the Examples herein, the amount of electrical energy (e.g., the current) applied to form the disclosed aluminum-carbon composition initiates an endothermic chemical reaction.

The disclosed aluminum-carbon material does not phase separate, after formation, when re-melted by heating the material to a melting temperature (i.e., a temperature at or above a temperature at which the resulting aluminum-carbon material begins to melt or becomes non-solid). Thus, the aluminum-carbon material is a single phase composition that is a stable composition of matter that does not phase separate upon subsequent re-melting. Furthermore, the aluminum-carbon material remains intact as a vapor, as the same chemical composition, as evidenced by magnetron sputtering and e-beam evaporation tests. Samples of the aluminum-carbon material were sputtered and upon sputtering were deposited as a thin film on a substrate and retained the electrical resistivity of the bulk material being sputtered. If the aluminum and carbon were not bonded together, then it would have been expected from electrical engineering principles and physics that the electrical resistivity would be roughly two orders of magnitude higher. This did not occur.

The carbon in the disclosed metal-carbon compound may be obtained from any carbonaceous material capable of producing the disclosed metal-carbon composition. Certain carbon containing compounds and/or polymers such as hydrocarbons are not suitable to produce the disclosed composition. The carbon is not in the form of a carbide, which are conventional reinforcements for aluminum. Furthermore, the carbon is not present as an organic polymer. Thus, the carbon is not a plastic, such as polyethylene, polypropylene, polystyrene, or the like.

Suitable carbonaceous material is preferably a generally or substantially pure carbon powder. Non-limiting examples include high surface area carbons, such as activated carbons, and functionalized or compatibilized carbons (as familiar to the metal and plastics industries). A suitable non-limiting example of an activated carbon is a powdered activated carbon available under the trade name WPH® available from Calgon Carbon Corporation of Pittsburgh, Pa. Functionalized carbons may be those that include another metal or substance to increase the solubility or other property of the carbon relative to the metal the carbon is to be reacted with, as disclosed herein. In one aspect, the carbon may be functionalized with nickel, copper, aluminum, iron, or silicon using known techniques, but not in the form of metal carbides. While powdered carbon is preferred, the carbon is not limited thereto and may be provided as courser material, including flaked, pellet, or granular forms, or combinations thereof. The carbon may be produced from coconut shell, coal, wood, or other organic source with coconut shell being the preferred source for the increased micropores and mesopores.

The metal herein is aluminum. The aluminum may be any aluminum or aluminum alloy capable of producing the disclosed aluminum-carbon compound. Those skilled in the art will appreciate that the selection of aluminum may be dictated by the intended application of the resulting aluminum-carbon compound. In one embodiment, the aluminum is 0.9999 aluminum. In one embodiment, the aluminum is an A356 aluminum alloy. In another embodiment the aluminum is 6061, 5083, or 7075 aluminum alloys.

In another aspect, the single phase metal-carbon material may be included in a composition or may be considered a composition because of the presence of other impurities or other alloying elements present in the metal and/or metal alloy.

Similar to metal matrix composites, which include at least two constituent parts—one being a metal, the aluminum-carbon compositions disclosed herein may be used to form aluminum-carbon matrix composites. The second constituent part in the aluminum-carbon matrix composite may be a different metal or another material, such as but not limited to a ceramic, glass, carbon flake, fiber, mat, or other form. The aluminum-carbon matrix composites may be manufactured or formed using known and similarly adapted techniques to those for metal matrix composites such as powder metallurgy techniques.

In one aspect, the disclosed aluminum-carbon compound or composition may comprise at least about 0.01 percent by weight carbon. In another aspect, the disclosed aluminum-carbon compound or composition may comprise at least about 0.1 percent by weight carbon. In another aspect, the disclosed aluminum-carbon compound composition may comprise at least about 1 percent by weight carbon. In another aspect, the disclosed aluminum-carbon compound or composition may comprise at least about 5 percent by weight carbon. In another aspect, the disclosed aluminum-carbon compound or composition may comprise at least about 10 percent by weight carbon. In yet another aspect, the disclosed aluminum-carbon compound or composition may comprise at least about 20 percent by weight carbon.

In another aspect, the disclosed aluminum-carbon compound or composition may comprise a maximum of 1%, 5%, 10%, 15%, 20%, 25%, 30%, 35%, or 40% by weight carbon. In one embodiment, the aluminum-carbon compound or composition may have the maximum percent by weight carbon customized to provide particular properties thereto.

The percent by weight carbon present in the compound or composition may change the thermal conductivity, ductility, electrical conductivity, corrosion resistance, oxidation, formability, strength performance, and/or other physical or chemical properties. In the aluminum-carbon compound or composition it has been determined that increased carbon content increases toughness, wear resistance, thermal conductivity, strength, ductility, elongation, corrosion resistance, and energy density capacity and decreases coefficient of thermal expansion and surface resistance. Accordingly, the customization of the physical and chemical properties of the aluminum-carbon compounds or compositions can be tailored or balanced to targeted properties through careful research and analysis. A uniqueness of the aluminum-carbon material is that it can be tailored through the processing techniques, in particular the process may be tailored to orient the carbon to enhance certain properties such as those listed above.

The formation of the aluminum-carbon composition may result in a material having at least one significantly different property than the aluminum itself. For example, the aluminum-carbon composition has significantly enhanced thermal conductivity with a significantly reduced grain structure when compared to standard aluminum.

In one embodiment, the carbon is present in the aluminum-carbon material as about 0.01% to about 40% by weight of the composition. In another embodiment, the carbon is present in the aluminum-carbon material as about 1% to about 10% by weight, or about 20% by weight, or about 30% by weight, or about 40% by weight, or about 50% by weight, or about 60% by weight of the composition. In one embodiment, the carbon is present as about 1% to about 8% by weight of the composition. In yet another embodiment, the carbon is present as about 1% to about 5% by weight composition. In another embodiment, the carbon is present as about 3% by weight of the composition.

Accordingly, the disclosed metal-carbon compositions may be formed by combining certain carbonaceous materials with the selected metal to form a single phase material, wherein the carbon from the carbonaceous material does not phase separate from the metal when the single phase material is cooled and subsequently re-melted. The metal-carbon compositions may be used in numerous applications as a replacement for more traditional metals or metal alloys and/or plastics and in hereinafter developed technologies and applications.

EXAMPLES

Example A1-1

A reaction vessel was charged with 5.5 pounds (2.5 Kg) of 356 Aluminum. The aluminum was heated to a temperature of 1600° F., which converted the aluminum to its molten state.

The agitator end of a rotary mixer was inserted into the molten aluminum and the rotary mixer was actuated to form a vortex. While mixing, 50 grams of powdered activated carbon was introduced into the vortex of the molten aluminum using a vibratory feeder. The powdered activated carbon used was WPH® powdered activated carbon, available from Calgon Carbon Corporation of Pittsburgh, Pa. The carbon feed unit was set to introduce about 4.0 grams of carbon per minute such that the entire amount of carbon was introduced in about 12.5 minutes.

A carbon (graphite) electrode affixed to a DC source was positioned in the reaction vessel to provide a high current density while the mixture passed between the electrode and the grounded reaction vessel. The arc welder was a Pro-Mig 135 arc welder obtained from The Lincoln Electric Company of Cleveland, Ohio. Throughout the period the powdered activated carbon is introduced to the molten aluminum, and while continuing to mix the carbon into the molten aluminum, the arc welder was intermittently actuated to supply direct current at 315 amps through the molten aluminum and carbon mixture. The application of current to the mixture continues after the carbon addition is completed in order to complete the conversion of the aluminum-carbon mixture to the new aluminum-carbon material.

Two plates of aluminum-carbon material were poured after application of the direct current. A hood with a filter positioned above the reaction vessel captured thirteen grams of the un-reacted carbon.

After cooling, the aluminum-carbon composition was observed by the naked eye to exist in a single phase. The material was noted to have cooled rapidly. The cooled aluminum-carbon composition was then re-melted by heating a few hundred degrees Fahrenheit above the melting temperature and poured into molds, and no phase separation was observed.

Furthermore, testing showed that the aluminum-carbon composition had improved thermal conductivity, fracture toughness, and ductility in plate, when rolled into a thin strip, and when extruded into rods, significantly reduced grain structure, and numerous other property and processing enhancements not found in traditional aluminum.

Example A1-2

The same procedure as described in Example A1-1 is duplicated for this example, except that the temperature of the molten aluminum was maintained at about 1370° F. (230° less than example A1-1).

The melt at 1370° F. was very smooth and the color throughout the run was much darker than example A1-1 with a smooth surface throughout. Only nine grams of un-reacted carbon was present in the filter associated with the reaction vessel.

Two plates of aluminum-carbon material were poured after application of the direct current. After cooling, the aluminum-carbon composition was observed by the naked eye to exist in a single phase. The material was noted to have cooled rapidly. The cooled aluminum-carbon composition was then re-melted by heating a few hundred degrees Fahrenheit above the melting temperature and poured into molds, and no phase separation was observed.

Example A1-3

Eight pounds of aluminum alloy 5083 was added to a reaction vessel preheated to 100 degrees above the melting point of the alloy. Once the alloy was molten, the agitator end of a rotary mixer was inserted and actuated to form a vortex. While mixing with the rotary mixer, powdered activated carbon was introduced into the vortex slowly by a vibratory feeder until the reaction vessel contained an aluminum carbon mixture having 5% by weight carbon. The powdered activated carbon used was WPH® powdered activated carbon, available from Calgon Carbon Corporation of Pittsburgh, Pa.

A carbon (graphite) electrode affixed to a DC source was positioned in the reaction vessel. Throughout the period the powdered activated carbon is introduced to the molten aluminum, and while continuing to mix the carbon into the molten aluminum, the arc welder was intermittently actuated to supply direct current at 379 amps through the molten aluminum and carbon mixture. The application of current to the mixture continues after the carbon addition is completed in order to complete the conversion of the aluminum-carbon mixture to the new aluminum-carbon material.

Two plates of aluminum-carbon material were poured after application of the direct current. After cooling, the aluminum-carbon composition was observed by the naked eye to exist in a single phase. A hood with a filter positioned above the reaction vessel captured thirteen grams of the un-reacted carbon.

Example A1-4

In another example, the methods of Example A1-3 was repeated, but aluminum alloy 5086 was used as the starting material and 3 wt % carbon was added during the process. The resulting new aluminum-carbon material was poured into multiple molds for further testing. After cooling, the aluminum-carbon composition was observed by the naked eye to exist in a single phase.

Samples of an aluminum-carbon composition made accordingly to the procedure of Example A1-1, but containing aluminum alloy 6061 and 2.7 wt % by weight carbon based on the total weight of the sample. The samples were examined using various techniques, including electron backscatter diffraction, SEM and EDS Mapping. As shown in FIG. 1, the electron backscatter diffraction images demonstrate that the aluminum-carbon composition tested contained metals of much smaller "grain size" than the grain sizes shown in the aluminum alloy 6061, especially considering that the aluminum-carbon composition had to be enlarged onto to a 45 μm scale to see the individual "grains."

Figure 2:
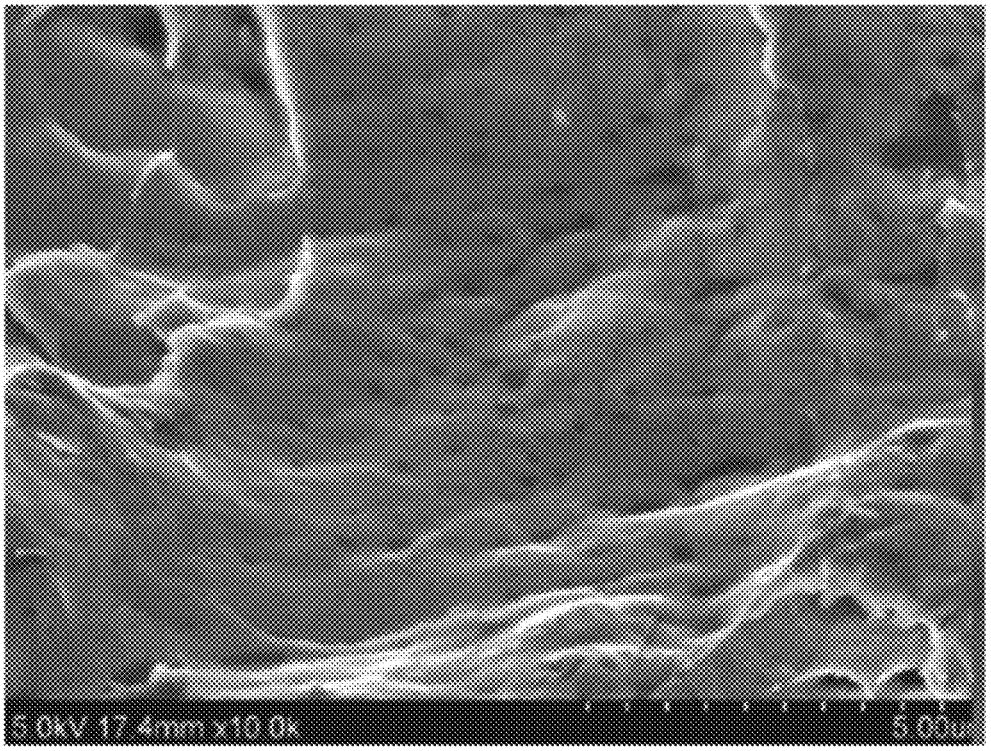
FIG. 2 includes an SEM image of a fractured surface of one embodiment of an aluminum-carbon composition that contains aluminum alloy 6061 and 2.7 wt % carbon showing an unusually smooth fracture surface instead of the expected cup and cone fracture of ductile metals, such as aluminum.

Referring to FIG. 2, a sample from the same aluminum-carbon composition was again imaged using scanning electron microscopy. However, a fractured surface of the sample was viewed.

Figure 3:
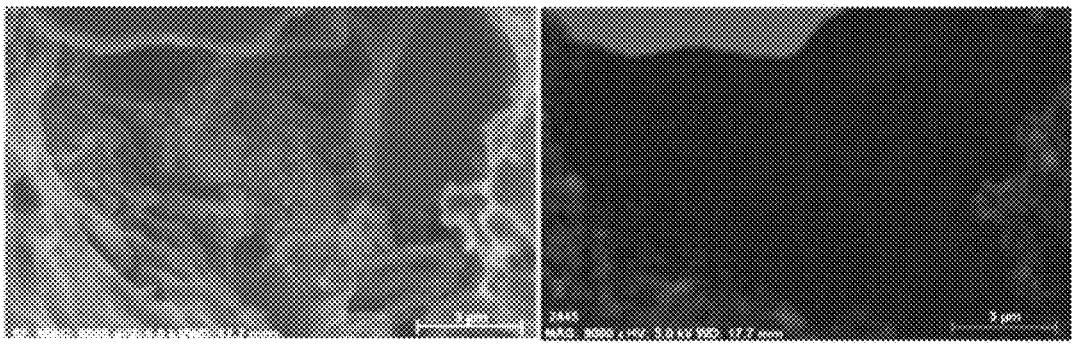
FIG. 3 includes EDS Map images of a fractured surface of one embodiment of an aluminum-carbon composition that contains aluminum alloy 6061 and 2.7 wt % carbon. The left image is an unfiltered image wherein no carbon is visible and the right image is filtered such that the carbon is represented as red in the image showing the nanoscale distribution of the carbon.

Referring to FIG. 3, a sample from the same aluminum-carbon composition having a fractured surface was analyzed by energy dispersive spectroscopy. The fractured surface provided an EDS Map as shown in the left image of FIG. 3. The EDS procedure was adjusted such that the carbon within the aluminum-carbon composition appears red in the right image, which is an image of the same portion of the fracture surface shown in the left image.

Figure 4:
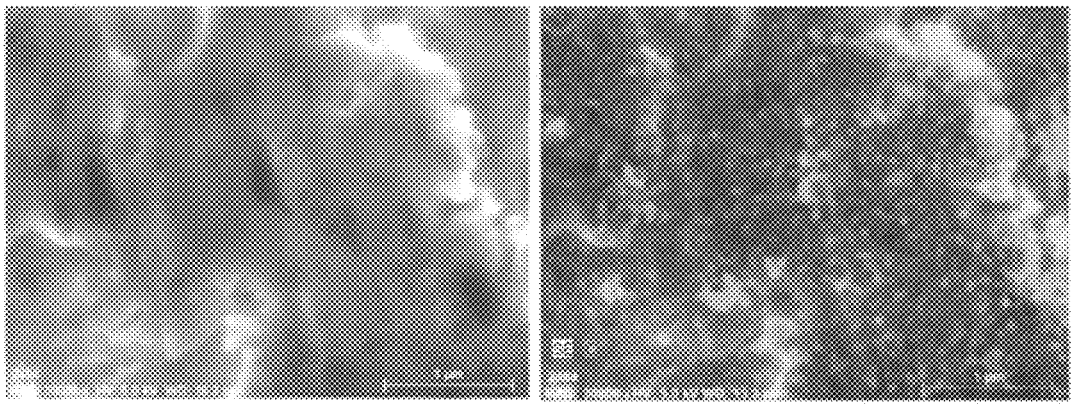
FIG. 4 includes SEM images of an as extruded surface of one embodiment of an aluminum-carbon composition that contains aluminum alloy 6061 and 2.7 wt % carbon. The left image is an unfiltered image wherein some microscale carbon is visible and the right image is filtered such that the carbon is represented as turquoise in the image showing the nanoscale distribution of the carbon.

Referring to FIG. 4, a sample from the same aluminum-carbon composition was imaged using a scanning electron microscope. The images in FIG. 4 are of a surface of the composition as extruded. The left image is a standard SEM image. The right image is filtered such that the carbon is visually represented by a turquoise color. As can be seen from the images, a nanoscale distribution of the carbon interconnected by or through "threads," a "matrix," or "network" of carbon is evident.

Furthermore, testing showed that the aluminum-carbon composition had improved thermal conductivity, fracture toughness, and ductility in plate, when rolled into a thin strip, when extruded into rods or wires, cast, significantly reduced grain structure, and numerous other property and processing enhancements not found in traditional aluminum.

What is claimed is:

1. An aluminum-carbon composition comprising:

aluminum chemically bonded to carbon, wherein the aluminum and the carbon form a single phase material formed by mixing carbon into the aluminum while molten and applying electrical energy thereto, using an arc welder, to initiate an endothermic reaction between the aluminum and the carbon, characterized in that the single phase material is meltable and that the carbon does not phase separate from the aluminum when the single phase material is subsequently re-melted or is deposited as a film of the single phase material by magnetron sputtering or e-beam evaporation;

wherein the single phase material is not aluminum carbide, $Al_4C_3$, nor an Al—C metal matrix composite, and has a nanoscale distribution of carbon interconnected by a network of carbon as viewed by a scanning electron microscopy image at one micrometer.

2. The aluminum-carbon composition of claim 1 wherein the aluminum is an aluminum alloy.

3. The aluminum-carbon composition of claim 1 wherein the carbon comprises about 0.01 to about 40 percent by weight of the material.

4. The aluminum-carbon composition of claim 1 wherein the carbon comprises at least about 1 percent by weight of the material.

5. The aluminum-carbon composition of claim 1 wherein the carbon comprises at least about 5 percent by weight of the material.

6. The aluminum-carbon composition of claim 1 wherein the carbon comprises at most about 10 percent by weight of the material.

7. The aluminum-carbon composition of claim 1 wherein the carbon comprises at most about 25 percent by weight of the material.

8. The aluminum-carbon composition of claim 1 further comprising an additive that imparts a change to a physical or mechanical property of the composition.

9. The aluminum-carbon composition of claim 1 wherein the carbon is a high surface area carbon.

10. The aluminum-carbon composition of claim 9 wherein the high surface area carbon is a powdered bituminous-based activated carbon.

11. An aluminum-carbon composition consisting essentially of:

aluminum chemically bonded to carbon, wherein the aluminum and the carbon form a single phase material formed by mixing carbon into the aluminum while molten and applying electrical energy, using an arc welder, thereto to initiate an endothermic reaction between the aluminum and the carbon, characterized in that the single phase material is meltable and that the carbon does not phase separate from the aluminum when the single phase material is subsequently re-melted or is deposited as a film of the single phase material by magnetron sputtering or e-beam evaporation;

wherein the single phase material is not aluminum carbide, $Al_4C_3$, nor an Al—C metal matrix composite, and has a nanoscale distribution of carbon interconnected by a network of carbon as viewed by a scanning electron microscopy image at one micrometer.

12. The aluminum-carbon composition of claim 11 wherein the aluminum is an aluminum alloy.

13. The aluminum-carbon composition of claim 11 wherein the carbon comprises about 0.01 to about 40 percent by weight of the material.

14. The aluminum-carbon composition of claim 11 wherein the carbon comprises at least about 1 percent by weight of the material.

15. The aluminum-carbon composition of claim 11 wherein the carbon comprises at least about 5 percent by weight of the material.

16. The aluminum-carbon composition of claim 11 wherein the carbon comprises at most about 10 percent by weight of the material.

17. The aluminum-carbon composition of claim 11 wherein the carbon comprises at most about 25 percent by weight of the material.

18. The aluminum-carbon composition of claim 11 wherein the carbon is a high surface area carbon.

19. The aluminum-carbon composition of claim 18 wherein the high surface area carbon is a powdered bituminous-based activated carbon.

* * * * *